US006167582B1

(12) United States Patent
Wiedeck

(10) Patent No.: US 6,167,582 B1
(45) Date of Patent: Jan. 2, 2001

(54) FLOATING BRIDGE

(75) Inventor: Hans-Norbert Wiedeck, Mülheim/Ruhr (DE)

(73) Assignee: MAN Technologies AG, Augsburg (DE)

( * ) Notice: Under 35 U.S.C. 154(b), the term of this patent shall be extended for 0 days.

(21) Appl. No.: 09/175,314

(22) Filed: Oct. 20, 1998

(30) Foreign Application Priority Data

Oct. 20, 1997 (DE) ..... 197 46 293

(51) Int. Cl.[7] ..... E01D 15/14
(52) U.S. Cl. ..... 14/2.6; 14/27
(58) Field of Search ..... 14/2.4, 2.5, 2.6, 14/13, 27, 28, 29, 30, 73.1; 404/47, 50, 54, 64

(56) References Cited

U.S. PATENT DOCUMENTS

| | | | | |
|---|---|---|---|---|
| 1,852,338 | * | 4/1932 | Shaffer | 14/27 |
| 2,321,677 | * | 6/1943 | Higgins | 14/2.4 |
| 2,825,077 | * | 3/1958 | Sedlacek et al. | 14/27 |
| 3,021,544 | * | 2/1962 | Gillois et al. | 14/2.6 |
| 3,066,332 | * | 12/1962 | Sedlacek | 14/27 |
| 3,504,389 | * | 4/1970 | Longbottom | 14/27 |
| 3,824,644 | * | 7/1974 | Stranzinger | 14/27 |
| 3,894,307 | * | 7/1975 | Delamare | 14/2.4 |
| 4,321,882 | | 3/1982 | Sluys | 114/266 |
| 4,386,441 | * | 6/1983 | Lundholm | 14/2.6 |
| 4,621,385 | * | 11/1986 | Gillois | 14/2.4 |
| 5,606,929 | * | 3/1997 | Huang | 14/2.6 |
| 5,649,333 | * | 7/1997 | Chernjawski | 14/27 |
| 5,727,491 | * | 3/1998 | Emrich et al. | 14/2.6 |
| 5,888,017 | * | 3/1999 | Corrie | 404/64 |

FOREIGN PATENT DOCUMENTS

| | | | | |
|---|---|---|---|---|
| 737 573 | | 7/1943 | (DE) . | |
| 229476 | | 10/1963 | (DE) . | |
| 23 51 314 | | 4/1975 | (DE) . | |
| 76 13 498 | | 11/1976 | (DE) . | |
| 33 08 071 | | 9/1984 | (DE) . | |
| 42 32 354 | | 3/1994 | (DE) . | |
| 44 37 071 | | 4/1996 | (DE) . | |
| 195 43 297 | | 5/1997 | (DE) . | |
| 2254682 | * | 7/1975 | (FR) | 14/2.6 |
| 210508 | * | 8/1989 | (JP) | 14/2.6 |
| 404333704 | * | 11 1992 | (JP) | 14/27 |
| 7 705 635 | | 11/1977 | (NL) . | |
| 2004667 | * | 12 1993 | (RU) | 14/2.6 |
| 2004669 | * | 12/1993 | (RU) | 14/2.6 |
| 174580 | * | 3/1961 | (SE) | 14/27 |
| 147216 | * | 6/1977 | (SU) | 14/27 |

OTHER PUBLICATIONS

*The Military Engineer,* May–Jun., 1962, pp. 2583–2584.
Patent Abstract of Japan, M–46, Dec. 11, 1980, vol. 4, No. 179 (JP 55–1527888 A).

* cited by examiner

*Primary Examiner*—Thomas B. Will
*Assistant Examiner*—Kristine M. Markovich
(74) *Attorney, Agent, or Firm*—Venable; Robert Kinberg

(57) ABSTRACT

A floating bridge includes at least two pontoons adjoining one another in a longitudinal direction of the bridge. Each pontoon includes two outside floats and at least two inside floats hinged together in a transverse direction of the bridge. Each float includes an upper roadway section and at least the inside floats each include a bottom plate having an integrated tension chord. Connecting elements connecting the inside floats of the two adjoining pontoons. The connecting elements are arranged in a region of the tension chords integrated into the bottom plates of the inside floats and respectively connect the tension chords of the two adjoining inside floats. Each connecting element comprises a bolt coupling including a horizontally arranged bolt. The connecting elements are arranged so that a spacing exists in a region of the roadway section between the inside floats of the adjoining pontoons to permit a powerless tilting of the respective adjoining pontoons relative to each other and around the bolts of the connecting elements.

7 Claims, 4 Drawing Sheets

FLOATING BRIDGE

CROSS-REFERENCE TO RELATED APPLICATIONS

Priority is claimed with respect to German application No. P 197 46 293.6 filed in Germany on Oct. 20, 1997, the disclosure of which is incorporated herein by reference.

BACKGROUND OF THE INVENTION

The invention relates to a floating bridge or ferry (herein collectively referred to as "floating bridge"), used in particular for military purposes and comprising several pontoons, wherein each pontoon is composed of two outside floats and at least two inside floats that are hinged together in transverse direction of the bridge by connecting elements, wherein connecting elements respectively also connect the inside floats of individual pontoons in a longitudinal direction of the bridge.

The connecting points between the individual pontoons are configured so that only the inside floats are joined in the longitudinal direction of the bridge, wherein bolt couplings are used for this. So-called tension chords are integrated into the floats to form the main supporting section of the floating bridge. The bridge roadway sections of the pontoons joined in this way are not joined in the longitudinal direction of the bridge, so that a nearly unlimited negative tilting of the individual pontoons is possible.

Such floating bridges were primarily developed during the Seventies and introduced on a large scale to the various, different nations. Based on the standard combat weight for tracked vehicles at that time, the floating bridges were designed for the military load classes MLC 50 (approx. 50 t) and MLC 60 (approx. 60 t). However, present-day battle tanks are in the load class MLC 70 (approx. 70 t). The previously introduced floating bridges consequently require special reinforcement measures to support these higher loads.

One such reinforcement measure for transferring higher loads can consist in an increase in the buoyancy volume. In accordance with a corresponding suggestion, the outside floats are to be replaced with new floats having a higher buoyancy volume with the same or improved flow behavior (DE 195 43 297 C1) while the inside floats remain unchanged and are used as before. This measure makes it possible to achieve an increase in the buoyancy and thus an increase in the carrying capacity of the individual pontoons on the order of 10% to 20%. To be sure, the pontoons under load are submerged somewhat less in this case. However, the buoyancy forces acting upon the pontoons do not change on the whole, so that this measure does not result in a significant reduction in the stress exerted on the tension chord as the main supporting member of the floating bridge. A load increase on the pontoons leads to a nearly linear rise in the tensile forces in the tension chord, so that an increase in the buoyancy volume does not lead to the desired increase in the carrying capacity of the total system, meaning the floating bridge, but to a failure of the tension chord.

SUMMARY OF THE INVENTION

An object of the invention therefore is to increase the carrying capacity of a floating bridge, without making costly changes to the inside floats, while at the same time reducing the forces acting upon the underside of the chord.

The above and other objects are accomplished according to the invention by the provision of a floating bridge, comprising: at least two pontoons adjoining one another in a longitudinal direction of the bridge, each pontoon including two outside floats and at least two inside floats hinged together in a transverse direction of the bridge, each float including an upper roadway section and at least the inside floats each including a bottom plate having an integrated tension chord; and connecting elements connecting the inside floats of the two adjoining pontoons, the connecting elements being arranged in a region of the tension chords integrated into the bottom plates of the inside floats and respectively connecting the tension chords of the two adjoining inside floats, each connecting element comprising a bolt coupling including a horizontally arranged bolt, and the connecting elements being arranged so that a spacing exists in a region of the roadway section between the inside floats of the adjoining pontoons to permit a powerless tilting of the respective adjoining pontoons relative to each other and around the bolts of the connecting elements.

A sufficiently positive tilting of the individual pontoons is possible because the connecting elements are arranged exclusively in the region of the bottom plates and the bolts for the bolt couplings extend horizontally.

A corresponding selection of the spacing between the inside floats of the longitudinally adjoining pontoons determines the degree of tilting for the individual pontoons.

By accepting lower submerging depths, the floating bridge design according to the invention will lead to such a concentration of the buoyancy forces in the area immediately surrounding the load acting upon the floating bridge that a reduction in stress on the tension chords is achieved.

The bridge system can be optimized by using suitable calculation methods and specifying the value for the powerless tilting of the pontoons relative to each other, as well as through an increase in buoyancy, such that the tensile forces in the tension chord are not exceeded if the permissible freeboard is maintained.

In one embodiment of the invention, each inside float is provided with a pressure pad at its end face, in the region of the roadway section, adjoining the end face of the inside float of the adjoining pontoon, which pressure pads transfer the pressure forces occurring in the region of the roadway sections.

A further embodiment of the invention provides for means between the inside floats of longitudinally adjoining pontoons, which make it possible to adjust the spacing existing between adjoining floats in the region of the roadway sections, thereby permitting an exact adaptation of the tilting of the individual pontoons to the respective load on the floating bridge.

The floating bridge according to the invention can be improved further in that the means for adjusting the spacing between the adjoining inside floats of individual pontoons comprise spindle-shaped thrust bolts, which engage in corresponding threads that are provided in the roadway section for accommodating them. It is thus possible to ensure a continuous adjustment of the spacing between the inside floats of longitudinally adjoining pontoons.

The floating bridge according to the invention is further improved in that the means provided for adjusting the spacing between the adjoining inside floats of individual pontoons consist of spacer elements or profile rods, e.g. angle brackets or T-profile rods, which are placed onto the pressure pads or are inserted between the two pressure pads facing each other. As a result of this, the spacing between adjoining inside floats can be reduced easily later on.

A particularly practical embodiment of the floating bridge according to the invention provides that the spacing between the adjoining inside floats of individual pontoons is formed through a subsequent grinding. This embodiment of the invention is particularly suitable for existing floating bridges having no spacing or insufficient spacing between adjoining inside floats.

BRIEF DESCRIPTION OF THE DRAWINGS

The drawing shows an exemplary embodiment of a floating bridge, wherein.

DETAILED DESCRIPTION OF THE INVENTION

Figure 1:
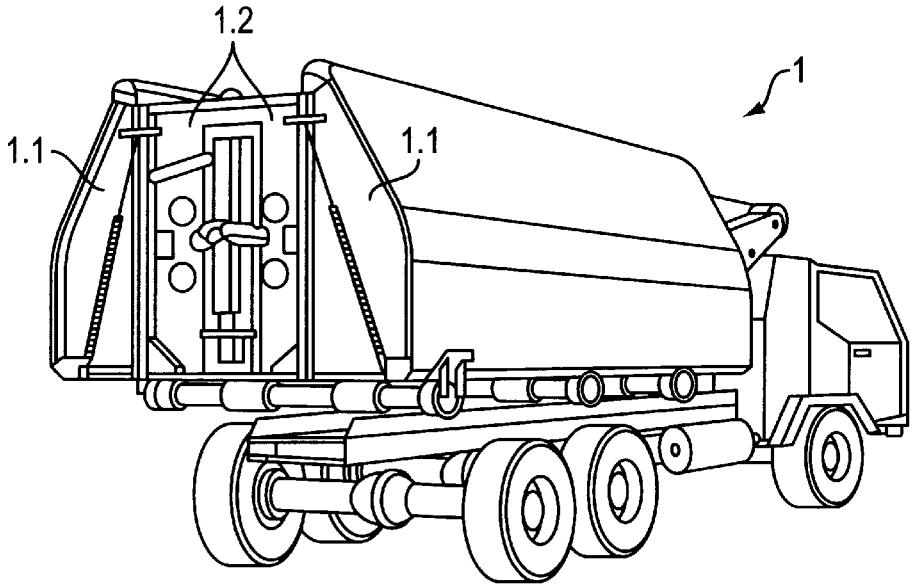
FIG. 1 shows a pontoon for a floating bridge in an upward-folded position and resting on a truck.
Figure 2:
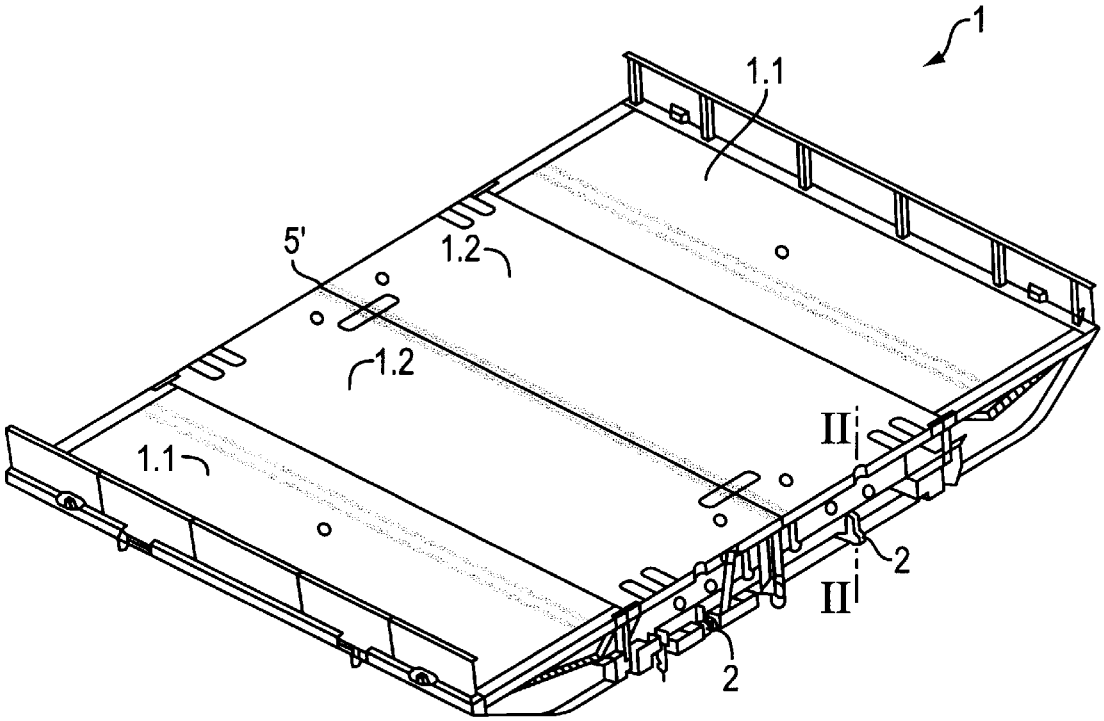
FIG. 2 shows the pontoon according to FIG. 1 in a position ready for placement.

FIGS. 1 and 2 illustrate how a pontoon 1 for a floating bridge, composed of four floats, is divided into outside floats 1.1 and inside floats 1.2. FIG. 1 shows pontoon 1 in a folded state being transported by a truck. FIG. 2 furthermore indicates connecting elements 2 for joining inside floats 1.2 of one pontoon 1 to inside floats of another, unillustrated pontoon which would be connected in a longitudinal direction of the bridge.

Figure 3:
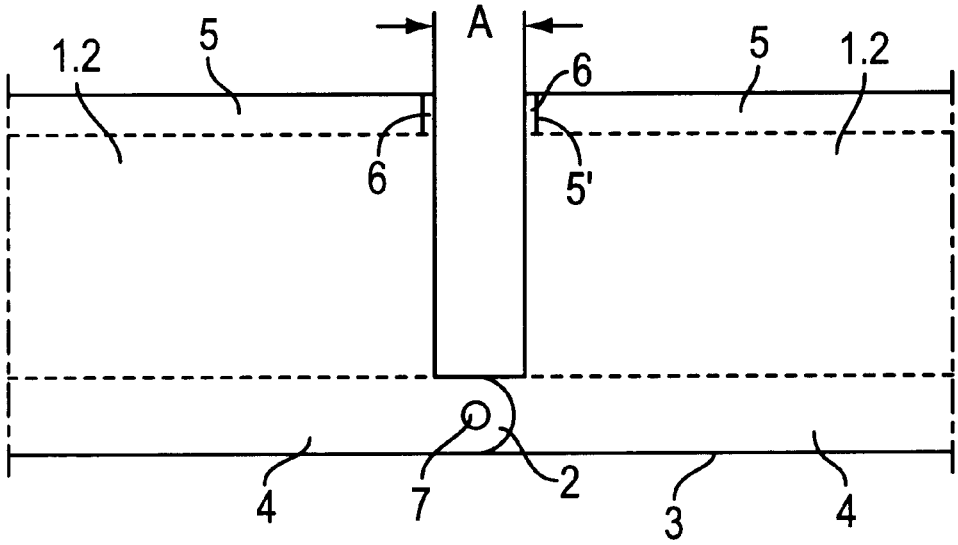
FIG. 3 shows a longitudinal section through the adjoining ends of two inside floats of adjoining pontoons, in the region II—II in FIG. 2.
Figure 4:
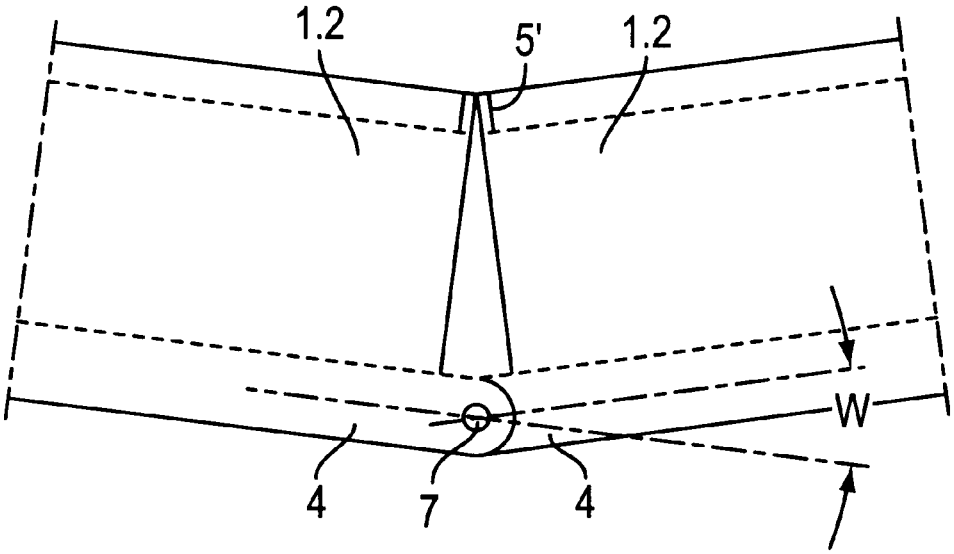
FIG. 4 shows the longitudinal section according to FIG. 3, with positive tilting of both inside floats.

FIGS. 3 and 4 are longitudinal sections through line II—II in FIG. 2 and show that connecting elements 2 are arranged in the region of tension chords 4, which are integrated into bottom plates 3 of each inside float 1.2. In the embodiment shown, the fronts (i.e. adjoining end faces) of roadway sections 5 are provided with ground edges 5' which have pressure pads 6, wherein a spacing A exists between the inside floats 1.2 of the pontoons adjoining one another in the longitudinal direction of the bridge. Owing to spacing A between inside floats 1.2, tension chords 4 can turn around bolts 7 of connecting elements 2, and inside floats 1.2 of the individual pontoons can thus tilt relative to each other by an angle W as shown in FIG. 4. The size of angle W in this case is determined by the size of spacing A (FIG. 3).

Figure 5:
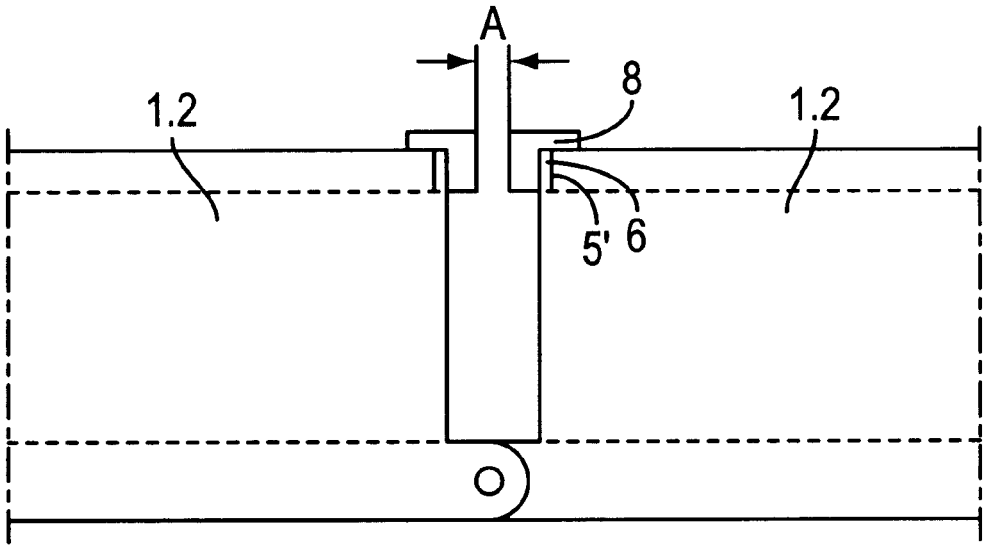
FIG. 5 shows a longitudinal section through the adjoining ends of two inside floats of adjoining pontoons according to another embodiment, also in the region of line II—II in FIG. 2.
Figure 6:
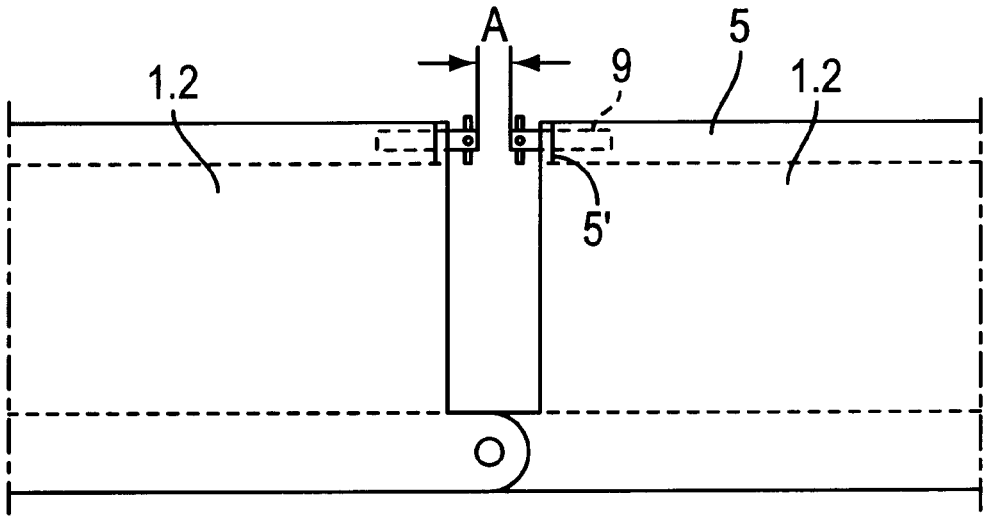
FIG. 6 shows a longitudinal section through the adjoining ends of two inside floats of adjoining pontoons according to a third embodiment.

Alternatively, the means for spacing can comprise profile rods, such as an angle bracket or a T-profile rod. In the embodiment shown in FIG. 5, angle brackets 8 serve as means for adjusting spacing A between the adjoining inside floats 1.2 of individual pontoons and are placed onto the pressure pads 6. In the embodiment shown in FIG. 6, the means for adjusting the spacing A between adjoining inside floats 1.2 of individual pontoons have spindle-shaped thrust bolts 9, which engage in corresponding threads provided in the roadway section 5 to accommodate them.

Figure 7:
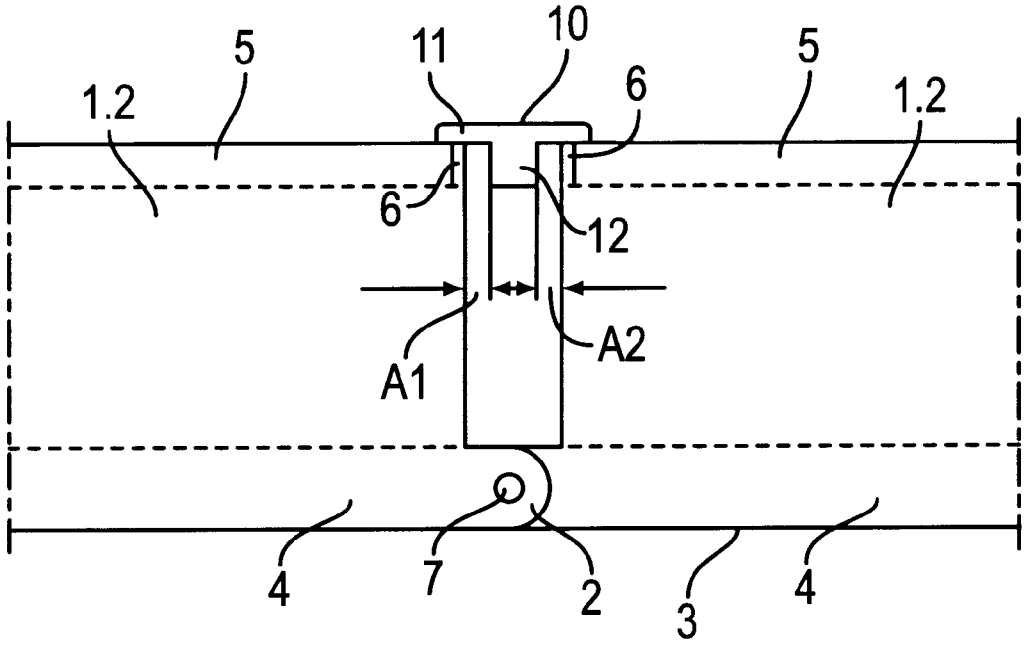
FIG. 7 shows a longitudinal section through the adjoining ends of two inside floats of adjoining pontoons according to yet another embodiment.

In the embodiment shown in FIG. 7, T-profile rods 10 are inserted between the roadway sections 5 of the adjoining inside floats 1.2, whereby the horizontal flange 11 of the rods 10 is laying upon the roadway sections and the vertical leg 12 of the rods is inserted in the spacing between the adjoining floats 1.2. On either side of the leg 12 is a partial spacing A1, A2 to the roadway section 5 of the respective float 1.2. Both partial spacings A1 and A2 amount to the effective spacing between the adjoining floats 1.2. The effective spacing A1+A2 may beadjusted by altering or changing the thickness of the leg 12.

The invention has been described in detail with respect to preferred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed is:

1. A floating bridge, comprising:

at least two pontoons adjoining one another in a longitudinal direction of the bridge, each pontoon including two outside floats and at least two inside floats hinged together in a transverse direction of the bridge, each float including an upper roadway section and at least the inside floats each including a bottom plate having an integrated tension chord; and connecting elements connecting the inside floats of the two adjoining pontoons, the connecting elements being arranged in a region of the tension chords integrated into the bottom plates of the inside floats and respectively connecting the tension chords of the two adjoining inside floats, each connecting element comprising a bolt coupling including a horizontally arranged bolt, and the connecting elements being arranged so that a spacing exists in a region of the roadway section between the inside floats of the adjoining pontoons to permit a powerless positive tilting of the respective adjoining pontoons relative to each other and around the bolts of the connecting elements, wherein the roadway sections of the inside floats have ground edges that define the spacing between the inside floats, and wherein the degree of positive tilting is limited by contact between the ground edges.

2. The floating bridge according to claim 1, wherein the adjoining pontoons have adjoining end faces and further including pressure pads disposed at the respective adjoining end faces in a region of the roadway sections.

3. The floating bridge according to claim 2, further including adjusting means between the inside floats of the adjoining pontoons for adjusting the spacing between the inside floats of the adjoining pontoons in the region of roadway sections.

4. The floating bridge according to claim 3, wherein the means for adjusting the spacing comprises spindle-shaped thrust bolts which engage in a threaded bore provided in a respective one of the roadway sections.

5. The floating bridge according to claim 3, wherein the means for adjusting the spacing comprises spacer elements inserted between the pressure pads of the inside floats of the adjoining pontoons.

6. The floating bridge according to claim 5, wherein the spacer elements comprise profile rods.

7. The floating bridge according to claim 6, wherein the profile rods comprise one of angle brackets and T-profile rods.

* * * * *